United States Patent [19]

Halstead

[11] Patent Number: 4,621,454

[45] Date of Patent: Nov. 11, 1986

[54] MECHANISM FOR CONTROLLABLY OPENING AND CLOSING APPLIANCE DOOR OR PANEL

[75] Inventor: Richard J. Halstead, Chesapeake, Va.

[73] Assignee: General Electric Company, Portsmouth, Va.

[21] Appl. No.: 708,147

[22] Filed: Mar. 4, 1985

[51] Int. Cl.[4] ..... E05F 1/10

[52] U.S. Cl. ..... 49/386

[58] Field of Search ..... 49/386; 220/269

[56] References Cited

U.S. PATENT DOCUMENTS

| | | | |
|---|---|---|---|
| 1,721,308 | 7/1929 | Lormor | 49/386 X |
| 2,565,202 | 8/1951 | Christison | 49/386 X |
| 2,605,494 | 8/1951 | Lyons, Jr. et al. | 49/386 X |
| 4,270,312 | 6/1981 | Courtis et al. | 49/386 X |

*Primary Examiner*—Kenneth Downey

[57] ABSTRACT

Mechanism for controlling the opening and closing of an appliance door or panel uses mechanical coupling members including a crank pivoted about an axis parallel to the axis on which the door or panel is hinged. The crank is connected to one end of a tension helical spring, while the other end of the spring is connected to a fixed anchor point. The crank is also connected to the door panel by means of a link. The spring undergoes a first phase of expansion with initial opening of the door. A deflective post is provided proximate to the spring which bends the spring and results in a second phase of more rapid spring expansion with further opening of the door for compensating for the increased torques acting on the door.

6 Claims, 4 Drawing Figures

MECHANISM FOR CONTROLLABLY OPENING AND CLOSING APPLIANCE DOOR OR PANEL

BACKGROUND OF THE INVENTION

1. Field of the Invention

This invention generally relates to door mechanisms, and more specifically to a mechanism for controlling the opening and closing of an appliance door or panel.

2. Description of the Prior Art

3. As a result of the sophistication of today's appliances, many of these have a large number of manually operated switches, buttons, or knobs which permit the control or adjustment of the appliance. This is true, for example, in the case of TV receivers which are typically provided with a large number of controls. While some manufacturers have placed some of these controls or knobs on the back of the units where they are out of view, this has made these knobs or controls less accessible and convenient to the user. In some instances, the controls have been placed on the front of the appliance and concealed by a door or panel which can be easily opened by the user to gain access.

The doors or panels provided on appliances, such as TV receivers, can be maintained in the closed, normally vertical, position by means of a simple spring such as a spiral or tension spring. However, the gravity or weight forces acting on the door as it moves from the vertical closed position to the horizontal open position are generally such that the torques exerted on the door are non-linear as a function of the pivoted rotational movements of the door. Since springs are generally linear tension devices, a problem has existed which either provides too much of a closing force when the door is almost in the closed position. This sometimes results in a forceful closing or a snapping action. However, when the effect of the spring action is lessened, the spring may not provide adequate forces on the door. This sometimes results in the door simply opening by itself or dropping to the open horizontal position, particularly when the unit is moved and the door is slightly tilted in the opening direction.

The use of simple springs to control the opening and closing of appliance doors or panels has not, therefore, proved fully satisfactory since the springs, as noted, are essentially linear devices while the forces acting on the doors or panels act in a non-linear fashion.

SUMMARY OF THE INVENTION

Accordingly, it is an object of the present invention to provide a mechanism for controllably opening and closing an appliance door or panel.

It is another object of the present invention to provide a mechanism which does not have the disadvantages inherent in prior art mechanisms.

It is still another object of the present invention to provide a mechanism of the type under discussion which is simple in construction and economical to manufacture.

It is yet another object of the present invention to provide a mechanism for regulating the opening and closing of an appliance door or panel which approximates and compensates the non-linear forces acting on the door to allow opening or closing of the door with substantially equal uniform external forces applied to the door.

It is a further object of the invention to provide a mechanism which substantially eliminates undesirable forceful closings of a door or panel or the dropping of same to open position.

In order to achieve the above objects, as well as others which will become apparent hereafter, the mechanism for controllably opening and closing an appliance door or panel in accordance with the present invention comprises a door or panel which is pivoted about a substantially horizontal axis for movement between first and second pivoted positions. The door exhibits a non-linear weight component force acting normally on said door to thereby produce a non-linear torque on the door as the door moves between the positions. Biassing means is provided for applying biassing forces in reaction to physical deformations thereto. Mechanical coupling means is provided connected to said biassing means for deforming said biassing means with movements of said door and for coupling said biassing forces to said door which at least approximate the non-linear weight component force acting normally on said door. In this manner, the non-linearity of said torque acting on said door is substantially compensated or neutralized, thereby allowing said door to be moved between said first and second positions by application of a substantially uniform external force on said door. In accordance with the presently preferred embodiment of the invention, the mechanism is used to control the opening and closing of a door or panel of a television receiver which is connected, by means of a link and a crank, to a single helical tension spring which undergoes a first purely stretching phase and a second phase in which the spring is both stretched and bent in order to increase the total amount of stretch of the spring. The second phase of stretching provides the higher tension forces to overcome the higher forces acting on the door required once the door opens beyond a predetermined amount from its initial closed vertical position.

BRIEF DESCRIPTION OF THE DRAWINGS

The features of this invention which are believed to be novel are set forth with particularity in the appended claims. The invention, together with its objects and advantages thereof, may best be understood by reference to the following description taken in conjunction with the accompanying drawings in which:

DESCRIPTION OF THE PREFERRED EMBODIMENT

Figure 1:
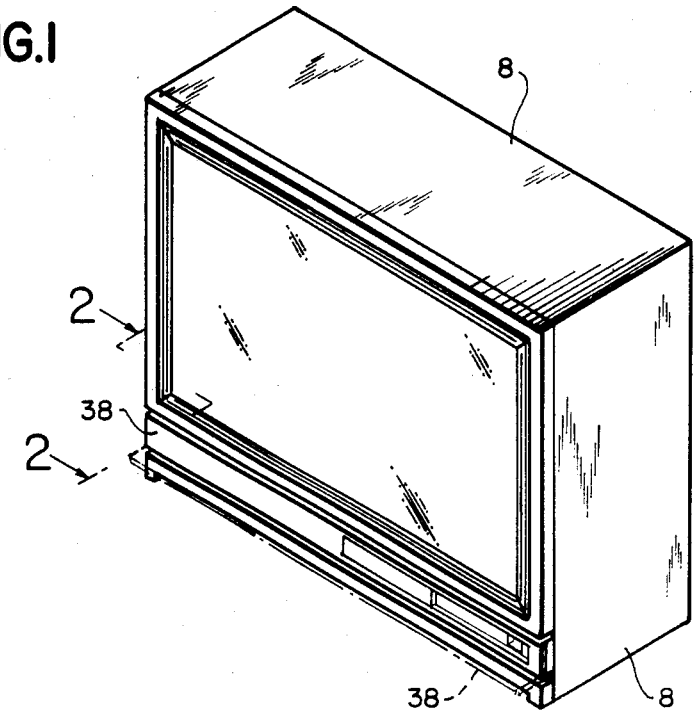
FIG. 1 a perspective view of a television receiver incorporating the door or panel mechanism in accordance with the present invention.

Referring specifically to the Figures, in which identical or similar parts are designated by the same reference numerals throughout, and first referring to FIG. 1, there is shown a television receiver 8 that incorporates the door or panel mechanism in accordance with the present invention which is generally designated by the reference number 10.

The mechanism 10 includes a mounting bracket 12 provided with a mounting flange 14 suitable for mounting on a chassis of an appliance in back or in the rear of the door or panel to be operated.

Figure 2:
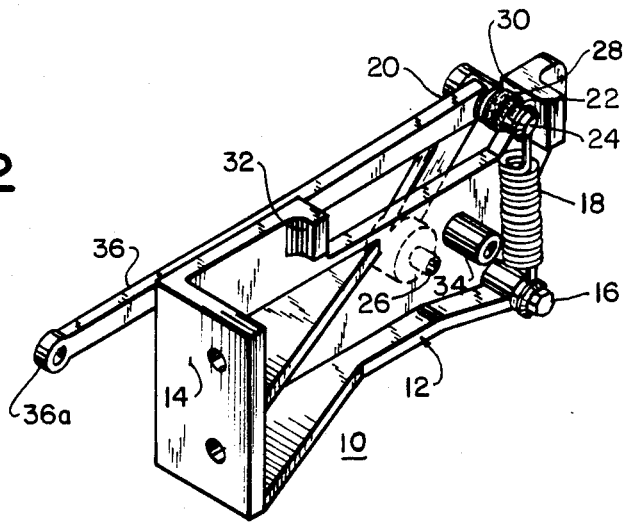
FIG. 2 is a perspective view of the door mechanism in accordance with the present invention.

Provided on the bracket 12 is a fixed anchor point 16 to which one end or hook of a helical tension spring 18 is connected by means of a retaining screw or any other conventional fastening member. The spring 18, to be more fully described below, is connected at its other hooked end to a crank 20 by receiving the hooked end within an annular recess 22 of a crank pin 24. The crank 20 is pivotally mounted at its lower end about pivot pin 26, the dimensions of the spring 18 and the crank 20 being selected to bias the crank 20 towards a rearward position, as viewed in FIG. 2, to bring the rubber sleeve or grommet 28 into abutment against a rear stop 30. Any movement of the crank 20 away from the rear stop 30 requires a force applied to the crank 20 which operates against the action of the spring 18.

Also connected to the crank 20 is a link or extension arm 36 which extends forward, again as viewed in FIG. 1, to permit the end 36*a* of the link 36 to be pivotally connected about a pin fastened to the door to be controlled.

Figure 3:
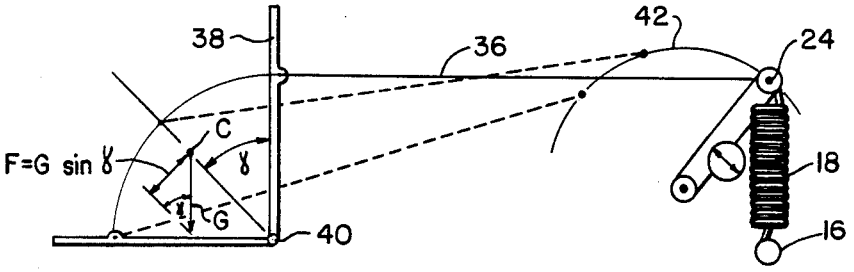
FIG. 3 is a diagrammatic representation of the moving elements of the mechanism illustrating the relationships, general positions and dimensions of the moveable elements in the closed position of the door or panel (solid lines), and the positions of some of these elements (in dashed lines) when the door is at a half way open (45°) or fully open (90°)

Referring to FIG. 3, specific dimensions are shown for the mechanism used to control a door or panel 38 between vertical and horizontal positions. The specifications of the spring 18 are that it is pre-tensioned at 0.7 lbs. and requires 1.26 lbs. to stretch the spring to 1.55 inches. The spring 18 includes 23 turns, has a wire diameter of 0.031 inches, and a spring outer diameter of 0.25 inches. The dimension shown in FIG. 3 as well as the spring specifications have been selected to control the door 40 which has a weight of 0.875 lbs.

As noted, because the spring 18 is pre-tensioned, it is effective to maintain the door closed until it is pulled open.

Referring to FIG. 3, a force G is shown which represents the weight of the door 38 acting through its center of gravity C. The component of the gravity force which acts in a direction normal to the door 38 is F which is equal to G sin $\gamma$, where $\gamma$ is the angle of opening of the door from its vertical position. In the vertical position, therefore, where $\gamma=0$, the force $F=0$ the entire weight G passes through the door pivot 40. As the door 38 is opened, the torque acting on the door is a sinusoidal function of the angle $\gamma$. It will be appreciated that for small angles of $\gamma$, sin $\gamma$ is small and very small torques are applied to the door. For example, door openings to angles of $\gamma=6°$ result in only 1/10th of the gravity or weight force being effective to producing a torque about to the door pivot point. For increased openings, of course, the torque component becomes more significant, reaching approximately 70% at $\gamma=45°$ and, of course, 100% at $\gamma=90°$.

Figure 4:
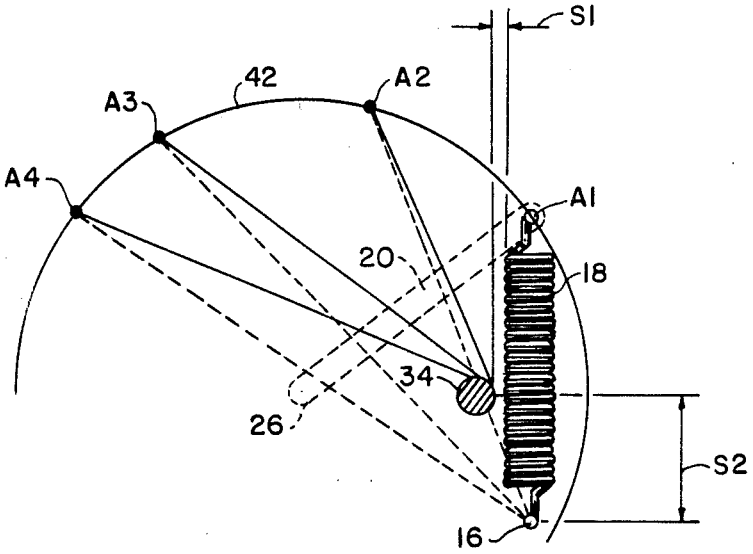
FIG. 4 is a diagrammatic representation of the spring and the deflecting post shown in FIGS. 1 and 2, showing the locus of points representing the bent and stretched positions of the spring for different positions of the door opening.

Referring to FIGS. 3 and 4, the principle of operation of the mechanism 10 will be described. The crank pin 24 moves along a circular path 42 about the crank pivot point 26. In the initial position of the mechanism 10, the crank 20 positions the upper, moveable end of the spring 18 at position A1. In this position, the spring 18 is spaced a distance S1 from the deflecting post 34. As previously noted, in this position, the spring 18 is pre-tensioned to insure that the crank 20 remains in the rearward most position against the rear stop 30 thereby maintaining the door or panel 38 in a closed position.

Initial rotation of the crank 20 about the pivot point 26 moves the upper end of the spring to successive positions along the circular path 42, as suggested by positions A2, A3, and A4. The initial movement of the crank will result in a simple stretching or elongation of the spring 18 which will, of course, apply a restoring force on the crank 20.

As will also be noted in FIG. 4, the counter-clockwise rotation of the crank 20 when the door 38 is opened results not only in a stretching of the spring 18 but also a movement of the spring in a lateral or transverse direction to its axial or longitudinal length. As viewed in FIG. 4, the dashed lines extending between the fixed anchor point 16 and the crank pin 24 positions A2, A3, and A4 represent the positions that the spring 18 would assume if the deflecting post 34 were not present. However, by positioning the deflecting post 34 in the path of the lateral or transverse movements of the spring 18, the spring is bent and stretched simultaneously, as suggested by the solid lines extending from the deflecting post 34 and the crank pin positions A2, A3, and A4. It will also be appreciated from FIG. 4 that the pin 34 effectively increases the extent of stretching of the spring 18 which would otherwise extend along the lines which represent the shortest distance between the anchor point 16 and the aforementioned crank pin positions. With the post 34 as shown, the effective length of the spring in each of the positions shown is essentially equal to the distance S2 added to one of the distances represented by the solid lines extending between the deflecting post 34 and the respective points A2, A3, and A4.

When the door is closed, $\gamma=0$ and the torque equal 0. However, because of the pre-tension on the spring 18, there is a tension applied to the crank 20 thereby maintaining the door 38 in a closed position. During initial opening of the door 38, up to approximately $\gamma=6°$, the spring 18 is in a first phase of expansion wherein it experiences simple stretching. Once the spring 18 engages or abuts against the deflecting post 34, the spring 18 goes through a second phase of expansion, wherein it is bent and stretched to effectively increase the rate of stretching and, therefore, to increase the rate of tension built up in the spring.

While the dominant force when the door is closed is the spring tension, this is advantageously reversed when the door is fully opened and $\gamma=90°$. Here, the torque exerted by the door 38 exceeds the tension forces exerted by the spring, even by a small amount, to make certain that the weight of the door maintains the door in an open position. The spring tension preferably balances the door weight or torque at approximately $\gamma=45°$. It is at that point when the system is balanced so that the door has no tendency to open or close.

Although the mechanism has been used with relatively heavy die cast door 38, it has controlled the opening and closing of the door in a smooth and substantially uniform fashion. Also, it has been noted that the door can be opened and closed substantially with a constant force applied by the user. It should be clear that the mechanism 10 has the ability to approximately fit the curve of the door torque distribution. This is done with an extremely simple mechanism which utilizes but a single spring 18.

While there has been described a particular embodiment to the present invention, it will be apparent that changes and modifications may be made therein without departing from the invention in its broader aspects. The aim of the dependent claims, therefore, is to cover all such changes and modifications as fall within the true spirit and scope of the invention. By way of example, only, the lengths of the crank 20 and the link 36 as well as the relative positions of the anchor point 16, pivot point 22 and the deflecting post 34 may all be modified to accommodate a different size door or panel 38. Also, the length, the pre-tensioning and the characteristics of the spring 18 may be changed to accommodate doors or panels having different weights. Furthemore, while curve fitting has been substantially achieved with this invention by the use of a single spring 18, the extent to which a curve must be fitted may depend on marketing requirements and manufacturing tolerances. It may, therefore, be possible to even more closely fit the curve shown in FIG. 4 so that the torque forces acting on the door are more fully compensated for over the entire range of door movements. This may, for example, be achieved with multiple or progressive series of springs, each having different dimensions and/or characteristics. For most applications where economies are to be observed, however, it has been found that the embodiment as described herein provides a significant improvement over comparable, inexpensive-type mechanisms.

What is claimed is:

1. Mechanism for controllably opening and closing an appliance door or panel comprising:

(a) a door or panel pivoted about a substantially horizontal axis for movement between first and second pivoted positions, said door exhibiting a non-linear weight component force acting normally on said door to thereby produce a non-linear torque on said door as said door moves between said positions;

(b) biassing means for applying biassing forces in reaction to physical deformations thereto; and (c) mechanical coupling means connected to said door and to said biasing means for deforming said biasing means with movements of said door and for creating biassing forces and coupling said biassing forces to said door which at least approximate the non-linear weight component force acting normally on said door, whereby the non-linearity of said torque acting on said door is at least partially compensated or neutralized, thereby allowing said door to be moved between said first and second positions by application of a substantially uniform external force on said door, said mechanical coupling means comprising a pivotally mounted crank connected to said biassing means and a link connecting said crank and said door.

2. Mechanism as defined in claim 1, wherein said biassing means comprising a spring.

3. Mechanism as defined in claim 2, wherein said biassing means comprises a helical tension spring which is in a pretensioned state when said door is in its first pivoted position.

4. Mechanism as defined in claim 3, further comprises deflecting means for bending said spring beyond a predetermined amount of initial elongation.

5. Mechanism as defined in claim 4, wherein said crank both stretches said spring and moves same in lateral or transverse direction to its axial or longitudinal length, said deflecting means being arranged in the path of lateral or transverse movement of said spring for bending and stretching said spring with increasing lateral movements of said spring.

6. Mechanism as defined in claim 5, wherein said deflecting means comprises a fixed post.

* * * * *